US009502743B2

(12) United States Patent
Nealis et al.

(10) Patent No.: US 9,502,743 B2
(45) **Date of Patent: *Nov. 22, 2016**

(54) SYSTEMS AND METHODS OF WAVEGUIDE ASSEMBLY USING LONGITUDINAL FEATURES

(71) Applicant: Aviat U.S., Inc., Santa Clara, CA (US)

(72) Inventors: Edwin Nealis, Cary, NC (US); Jayesh Nath, Milpitas, CA (US)

(73) Assignee: Aviat U.S., Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/468,658

(22) Filed: Aug. 26, 2014

(65) Prior Publication Data

US 2014/0361857 A1 Dec. 11, 2014

Related U.S. Application Data

(63) Continuation of application No. 13/250,672, filed on Sep. 30, 2011, now Pat. No. 8,816,799.

(60) Provisional application No. 61/388,446, filed on Sep. 30, 2010.

(51) Int. Cl.

| | |
|---|---|
| ***H01P 1/04*** | (2006.01) |
| ***H01P 11/00*** | (2006.01) |
| ***H01P 3/12*** | (2006.01) |

(52) U.S. Cl.

CPC ..... *H01P 1/042* (2013.01); *H01P 3/12* (2013.01); *H01P 11/002* (2013.01); *Y10T 29/49016* (2015.01); *Y10T 29/49826* (2015.01)

(58) Field of Classification Search

CPC ..... H01P 1/042; H01P 11/002

USPC ..... 333/254, 255; 29/600

See application file for complete search history.

(56) References Cited

U.S. PATENT DOCUMENTS

| | | | |
|---|---|---|---|
| 2,996,790 | A | 8/1961 | Trafford et al. |
| 3,221,279 | A | 11/1965 | Gross |
| 3,234,489 | A | 2/1966 | Hahne |

(Continued)

OTHER PUBLICATIONS

International Application No. PCT/US2011/054310, International Search Report and Written Opinion mailed Jan. 20, 2012.

*Primary Examiner* — Benny Lee

(74) *Attorney, Agent, or Firm* — Sheppard, Mullin, Richter & Hampton LLP

(57) ABSTRACT

Various embodiments provide for waveguide assemblies which may be utilized in wireless communication systems. Various embodiments may allow for waveguide assemblies to be assembled using tools and methodologies that are simpler than the conventional alternatives. Some embodiments provide for a waveguide assembly that comprises a straight tubular portion configured to be shortened, using simple techniques and tools, in order to fit into a waveguide assembly. For instance, for some embodiments, the waveguide assembly may be configured such that the straight portion can be shortened, at a cross section of the portion, using a basic cutting tool, such a hacksaw. In some embodiments, the straight portion may be further configured such that regardless of whether the straight tubular portion is shortened, the waveguide assembly remains capable of coupling to flanges, which facilitate coupling the straight tubular portion to connectable assemblies, such as other waveguide assemblies, radio equipment, or antennas.

26 Claims, 13 Drawing Sheets

(56) References Cited

U.S. PATENT DOCUMENTS

| | | | | |
|---|---|---|---|---|
| 3,337,822 | A | 8/1967 | Hahne | |
| 3,500,264 | A | 3/1970 | Floyd, Jr. | |
| 3,587,010 | A | 6/1971 | Walsh | |
| 3,784,938 | A | 1/1974 | Cuthbert et al. | |
| 6,415,091 | B1 | 7/2002 | Daub et al. | |
| 8,816,799 | B2 * | 8/2014 | Nealis et al. | H01P 11/002 29/600 |
| 2008/0018420 | A1 | 1/2008 | Prassmayer et al. | |

* cited by examiner

SYSTEMS AND METHODS OF WAVEGUIDE ASSEMBLY USING LONGITUDINAL FEATURES

CROSS-REFERENCE TO RELATED APPLICATIONS

This application is a continuation of and claims priority to U.S. Non-Provisional application Ser. No. 13/250,672, corresponding to U.S. Pat. No. 8,816,799, filed Sep. 30, 2011, issued Aug. 26, 2014, entitled "Systems and Methods of Waveguide Assembly Using Longitudinal Features" which claims priority to U.S. Provisional Application Ser. No. 61/388,446 filed Sep. 30, 2010, entitled "Low Cost Waveguide Design," which are both hereby incorporated by reference.

FIELD OF THE INVENTION(S)

The present invention(s) relate to waveguides, and more particularly, some embodiments relate to assembly of waveguide components.

DESCRIPTION OF THE RELATED ART

Point-to-point wireless communication systems commonly use waveguide units to transmit signals to and from antennas. Usually, these units are disposed between an antenna and a transmitting or receiving component of the wireless communication system (e.g., a microwave transceiver). Waveguide units generally comprise straight sections (often referred to herein as "straight portions") that span distances between two components or a component and an antenna, flanges which flank each end of the straight section, and, optionally, bends (e.g., E-bends and H-bends) that allow the waveguide unit to be routed around obstacles.

FIGS. 1-4 illustrate exemplar conventional waveguide units and/or components that are used within waveguide units. FIG. 1 depicts a conventional waveguide unit 100 comprising a straight section 104 having a first open end 112 (not completely visible) and a second open end 114, and flanges 102 and 106 in the prior art. The flanges 102 and 106 have attachment points 108 and 110, respectively. Generally, the flanges 102 and 106 are used to couple the waveguide unit 100 to connectable components, such as other waveguide components (e.g., a waveguide bends), radio equipment, or antennas. The attachment points 108 and 110 assist in such coupling.

The straight section 104 propagates electromagnetic waves. The straight section 104 commonly comprises tubing made of drawn copper or brass, which is suitable for silver soldering and/or brazing.

During assembly of the waveguide unit 100, the flanges 102 and 106 are usually coupled to the straight section 104 by way of solder (e.g., silver soldering) or brazing (e.g., torch brazing, furnace brazing, or dip-brazing). Alternately, the straight section 104 is made of an extruded aluminum alloy, to which flanges and bends can be coupled using dip-brazing, furnace brazing, or silver soldering and/or brazing (with silver-plated flanges or bends).

FIG. 2 depicts a conventional straight section 200 of a waveguide unit in the prior art. The conventional straight section 200 comprises drawn copper tubing. The straight section 200 lacks a coupling mechanism at the open end. Conventionally, the straight section 200 is soldered to a flange or other waveguide component. For example, the straight section 200 may be soldered to flanges which are used to connect to another waveguide component (e.g., a waveguide bend), radio equipment, or antenna. Alternatively, the open end may be coupled to a connectable component without use of a flange by way of soldering or brazing.

FIG. 3 illustrates a waveguide unit 300 in the prior art. The waveguide unit 300 may be used to direct the waveguide around other components of a radio (e.g., receiver component or transmitter component) or antenna. The waveguide unit 300 is made of flanges 302 and 318, straight sections 304, 310, and 316, E-bends 306 and 314, and H-bends 308 and 312. As shown, the straight sections 304 and 316 are coupled, respectively, to the flanges 302 and 306. The straight sections 304 and 316 are also coupled, respectively, to the E-bends 306 and 314. The straight section 310 is coupled between H-bends 308 and 312. The H-bend 308 is coupled between the E-bend 306 and the straight section 310. Similarly, the H-bend 312 is coupled between the E-bend 314 and the straight section 310. The flanges 302 and 318, straight sections 304, 310, and 316, E-bends 306 and 314, and H-bends 308 and 312 are bonded together using brazing.

FIG. 4 depicts a conventional H-bend 400 in the prior art. The H-bend 400 enables a smooth change in the direction of the axis of a waveguide. The axis remains in a plane parallel to the direction of magnetic H-field (transverse) polarization. The H-bend 400 is typically made of a drawn copper tubing. The H-bend 400 is generally coupled to other portions of the waveguide (e.g., straight sections or E-bends) using brazing.

BRIEF SUMMARY OF EMBODIMENTS OF THE INVENTION

Various embodiments provide for waveguide assemblies and methods thereof, which may be utilized in wireless communication systems, such as microwave communication systems.

According to some embodiments, a waveguide assembly is provided. In one example, the waveguide assembly comprises a straight tubular portion having a length and comprising a tube wall having an interior surface and an exterior surface. The straight tubular potion may have a first open end formed by the tube wall. The first open end may have a first cross section shape and an edge. A first longitudinal feature may be disposed on the interior surface or the exterior surface of the tube wall. The first longitudinal feature may extend along and parallel to the length of the straight tubular portion. The first longitudinal feature may form a first attachment point at the edge of the first open end. The waveguide assembly may also comprise a first attachable flange that corresponds to the first cross section shape, wherein the first attachable flange is configured to couple to the first open end such that the first open end aligns with the first attachable flange. A first fastener of the waveguide assembly may be configured to couple the first attachable flange to the first open end at the first attachment point. The first attachment point is configured to receive the first fastener. In some embodiments, the first longitudinal feature may be configured such that the first longitudinal feature forms the first attachment point when the straight tubular portion is cut at a cross section.

In some embodiments, the waveguide assembly may further comprise a second longitudinal feature disposed on a surface common with the first longitudinal feature. The second longitudinal feature may extend along and parallel to the length of the straight tubular portion. Further, the second longitudinal feature may form a second attachment point at the edge of the first open end. The waveguide assembly may further comprise a second fastener configured to couple the first attachable flange to the first open end at the second attachment point. The second attachment point may be configured to receive the second fastener. The first longitudinal feature and the second longitudinal feature may be configured to form a pair of rails capable of receiving and retaining a mounting bracket. In one example, the mounting bracket is coupled to the straight tubular portion using, at least in part, the pair of rails. Additionally, the first attachment point and the second attachment point may be further configured to function as openings of the pair of rails. In addition, the openings may also be capable of receiving the mounting bracket. The mounting bracket may be configured to assist in mounting the waveguide assembly to a frame.

In various embodiments, the first cross section shape may be quadrilateral wherein the exterior surface of the straight tubular portion comprises four faces. The first longitudinal feature and the second longitudinal feature may share a common face. Additionally, the interior surface of the straight tubular portion may comprise four faces, and the first longitudinal feature and the second longitudinal feature may share a common face. In some embodiments, the first longitudinal feature and the second longitudinal feature may be disposed at edges of the surface common between the first longitudinal feature and the second longitudinal feature.

Generally, the first attachable flange may be configured to couple the waveguide assembly to another waveguide assembly. For example, in some embodiments, the first attachable flange may be configured to couple the waveguide assembly to an E-bend or an H-bend.

In some embodiments, the waveguide assembly may further comprise a second attachable flange configured to couple to a second open end of a straight tubular section. The second attachable flange may be substantially aligned with the second open end. A third fastener may be configured to couple the second attachable flange to the second open end at a third attachment point formed by the first longitudinal feature at an edge of the second open end. The third attachment point may be configured to receive the third fastener.

A exemplary method for installing a waveguide assembly comprises measuring a first length between a first waveguide receiving point and a second waveguide receiving point, receiving a waveguide straight portion, a first flange, and a second flange, wherein the waveguide has a second length that is greater than or equal to the first length, wherein the waveguide has a first end and a second end, wherein the first flange has a first profile width that is less than the first length, and wherein the second flange has a second profile width that is less than the first length, shortening the waveguide straight portion from a second length to a third length, wherein the third length is less than the second length, and wherein the third length is shortened such that the third length combined with the first profile width and the second profile width permits the waveguide assembly to fit between and couple with the first waveguide receiving point and the second waveguide receiving point, and assembling the waveguide assembly by coupling the first flange to the wave straight portion at the first end, and coupling the second flange to the wave straight portion at the second end.

The method may further comprise coupling a mounting bracket to the waveguide straight portion. The mounting bracket may assist in mounting the waveguide assembly to a frame. Further, the method may comprise mounting the waveguide assembly to the frame and coupling the waveguide assembly to the first waveguide receiving point and the waveguide second receiving point.

According to some embodiments, a waveguide assembly comprises a means for causing a wave to propagate in one dimension. The means for causing the wave to propagate in one dimension may have a length and a first end having a first cross section shape. The waveguide assembly may further comprise a means for coupling the waveguide assembly to a first waveguide assembly. The means for coupling the waveguide assembly to the first waveguide assembly may correspond to the first cross section shape. Further, the means for coupling the waveguide assembly to the first waveguide assembly may be configured to couple to the first end such that the first end aligns with the means for coupling the waveguide assembly to the first waveguide assembly. The waveguide assembly may also further comprise a means for coupling the first end with the means for coupling the waveguide assembly to the first waveguide assembly. The means for coupling the first end with the means for coupling the waveguide assembly to the first waveguide assembly may extend along and parallel to the length of the means for causing the wave to propagate in one dimension.

The waveguide assembly may further comprise a means for coupling the waveguide assembly to a second waveguide assembly. The means for coupling the waveguide assembly to the second waveguide assembly may correspond to a second cross section shape of a second end of the means for causing the wave to propagate in one dimension. The means for coupling the waveguide assembly to the second waveguide assembly may be configured to couple to the second end such that the second end aligns with the means for coupling the waveguide assembly to the second waveguide assembly.

The waveguide assembly may further comprise a means for coupling the second end with the means for coupling the waveguide assembly to the second waveguide assembly. The means for coupling the second end with the means for coupling the waveguide assembly to the second waveguide assembly may extend along and parallel to the length of the means for causing the wave to propagate in one dimension. In some embodiments, the means for coupling the first end with the means for coupling the waveguide assembly to the first waveguide assembly may be the same as the means for coupling the second end with the means for coupling the waveguide assembly to the second waveguide assembly.

Other features and aspects of various embodiments will become apparent from the following detailed description, taken in conjunction with the accompanying drawings, which illustrate, by way of example, the features of the various embodiments.

BRIEF DESCRIPTION OF THE DRAWINGS

Various embodiments are described in detail with reference to the following figures. The drawings are provided for purposes of illustration only and merely depict some example embodiments. These drawings are provided to facilitate the reader's understanding of the various embodiments and shall not be considered limiting of the breadth, scope, or applicability of embodiments.

The figures are not intended to be exhaustive or to limit some embodiments to the precise form disclosed. It should be understood that various embodiments may be practiced with modification and alteration, and that various embodiments be limited only by the claims and the equivalents thereof.

DETAILED DESCRIPTION OF VARIOUS EMBODIMENTS

Various embodiments allow for waveguide assemblies to be assembled using tools and methodologies that are simpler than conventional alternatives. Waveguide units in the prior art are single units typically fused together using soldering or brazing techniques. Various embodiments herein describe a waveguide assembly that is not fused together (i.e., the waveguide assembly is not soldered or brazed). Rather, the waveguide assembly may be assembled in the field using parts that are joined with screws or other mechanical means. In some embodiments, the parts of the waveguide assembly are detachable. In some embodiments, a user may assemble the waveguide assembly as needed using a variety of parts when needed. As a result, the user may no longer be required to carry a large number of fused waveguide units which may or may not fit the needs at the time.

For example, a waveguide assembly may include a straight tubular portion to propagate electromagnetic waves. The straight tubular portion may be shorted by the user (e.g., cut) using simple techniques and tools, in order to fit as needed. In one example, the straight tubular portion may be shortened, at a cross section using a basic cutting tool, such a hacksaw. In some embodiments, the straight tubular portion may be capable of coupling to flanges regardless of where or how the straight tubular portion is shortened (e.g., by cutting). The flanges may facilitate coupling between the straight tubular portion and connectable components, such as other waveguide components, radio equipment, or antennas.

A waveguide assembly may be assembled using simple techniques and tools, thereby eliminating the need for special skills and equipment generally needed when assembling a conventional waveguide unit (e.g., no brazing or soldering needed). Assembling waveguide assemblies may be less complex and cheaper than fusing waveguide units. For example, in some embodiments, the waveguide assembly may comprise a straight portion comprising extruded aluminum without special plating (special plating is typically required for aluminum components in order to facilitate coupling in conventional fused waveguide units). Further, by obviating the need for special techniques and tools during assembly, some embodiments allow waveguide assemblies to be transported to installation sites in disassembled form rather than as fused units. In disassembled form, waveguide assemblies may be packaged optimally and easily such that the chances of damage during transport are reduced.

Figure 1:
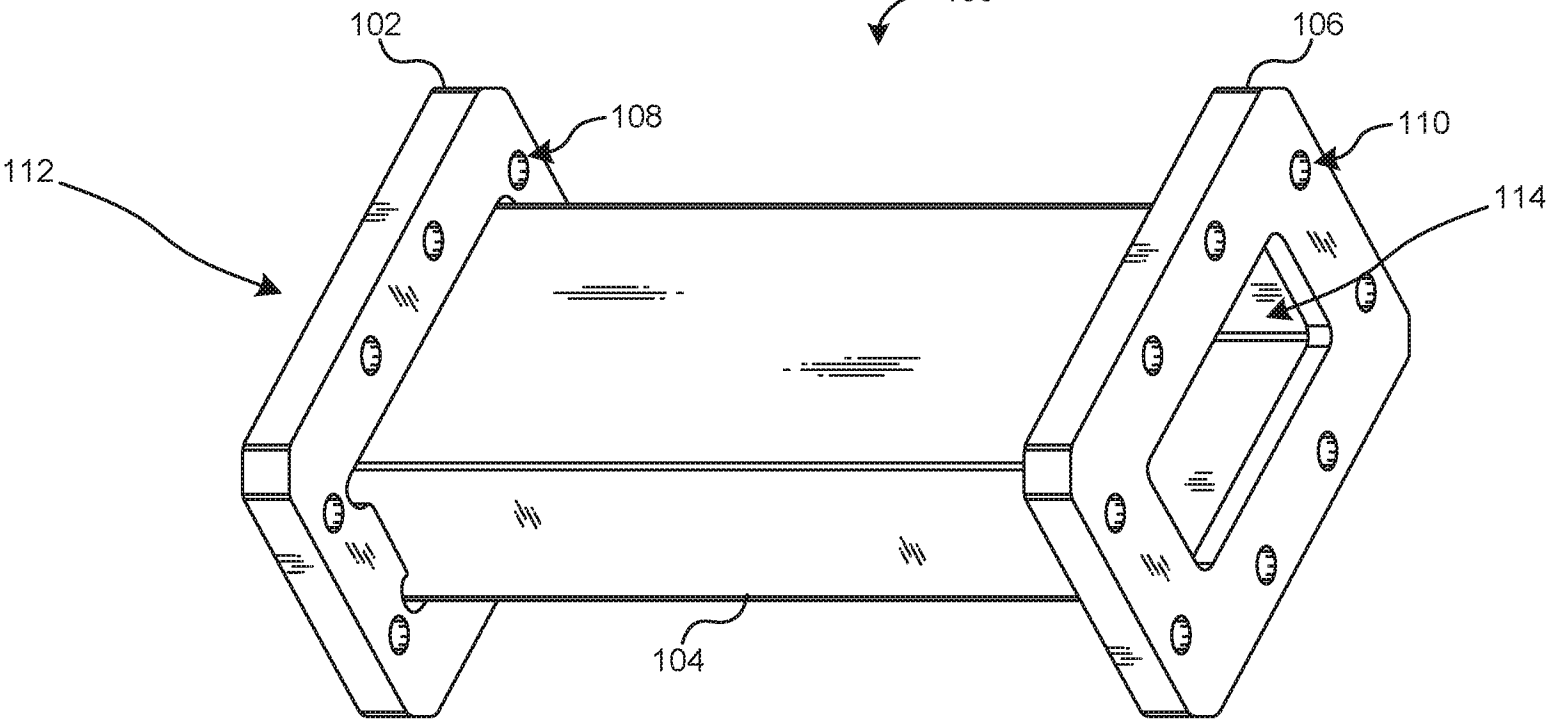
FIG. 1 (PRIOR ART)
FIG. 1 depicts a conventional waveguide unit comprising a straight section having a first open end (not completely visible) and a second open end, and flanges in the prior art.
Figure 2:
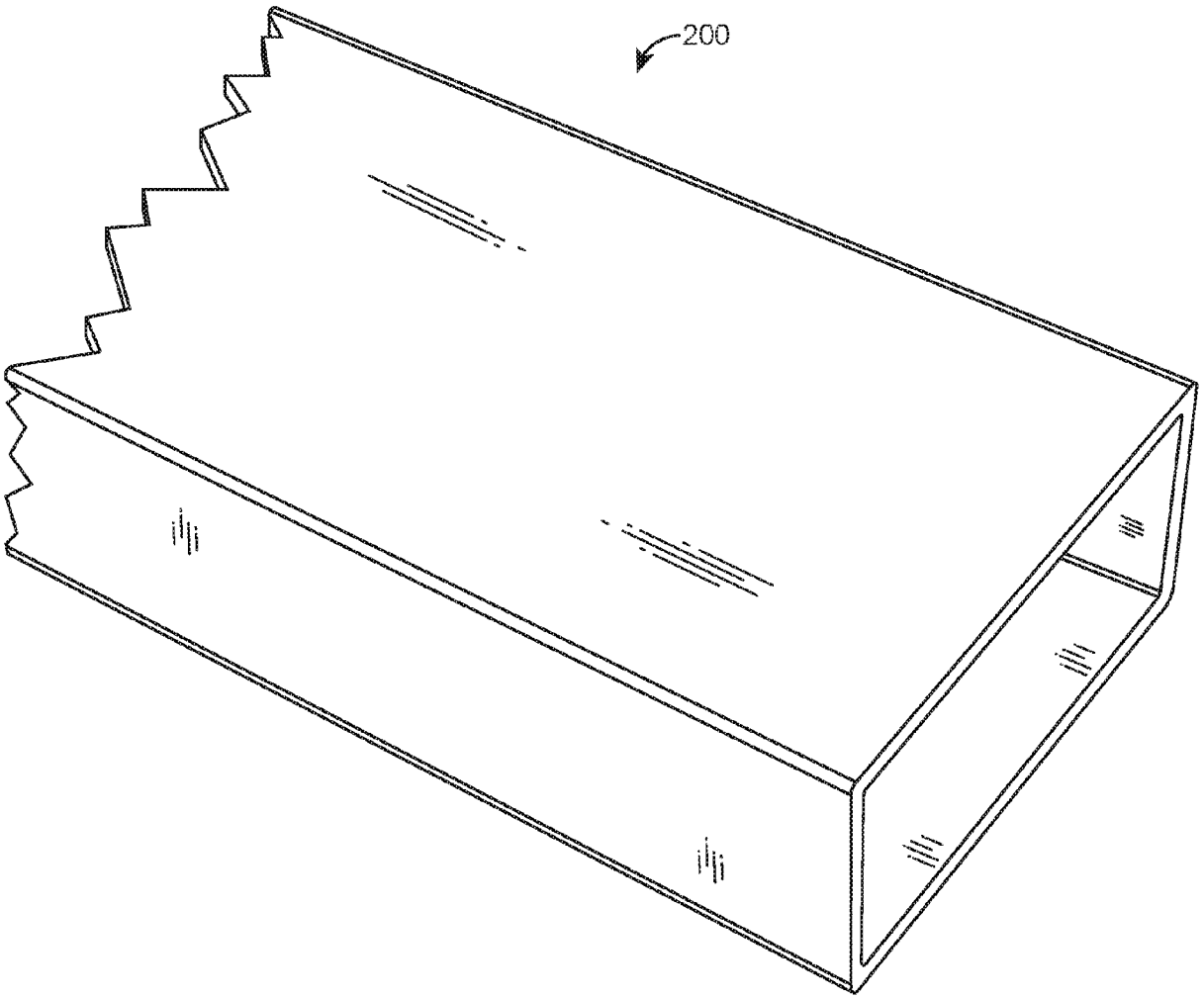
FIG. 2 (PRIOR ART)
FIG. 2 depicts a conventional straight section of a waveguide unit in the prior art.
Figure 3:
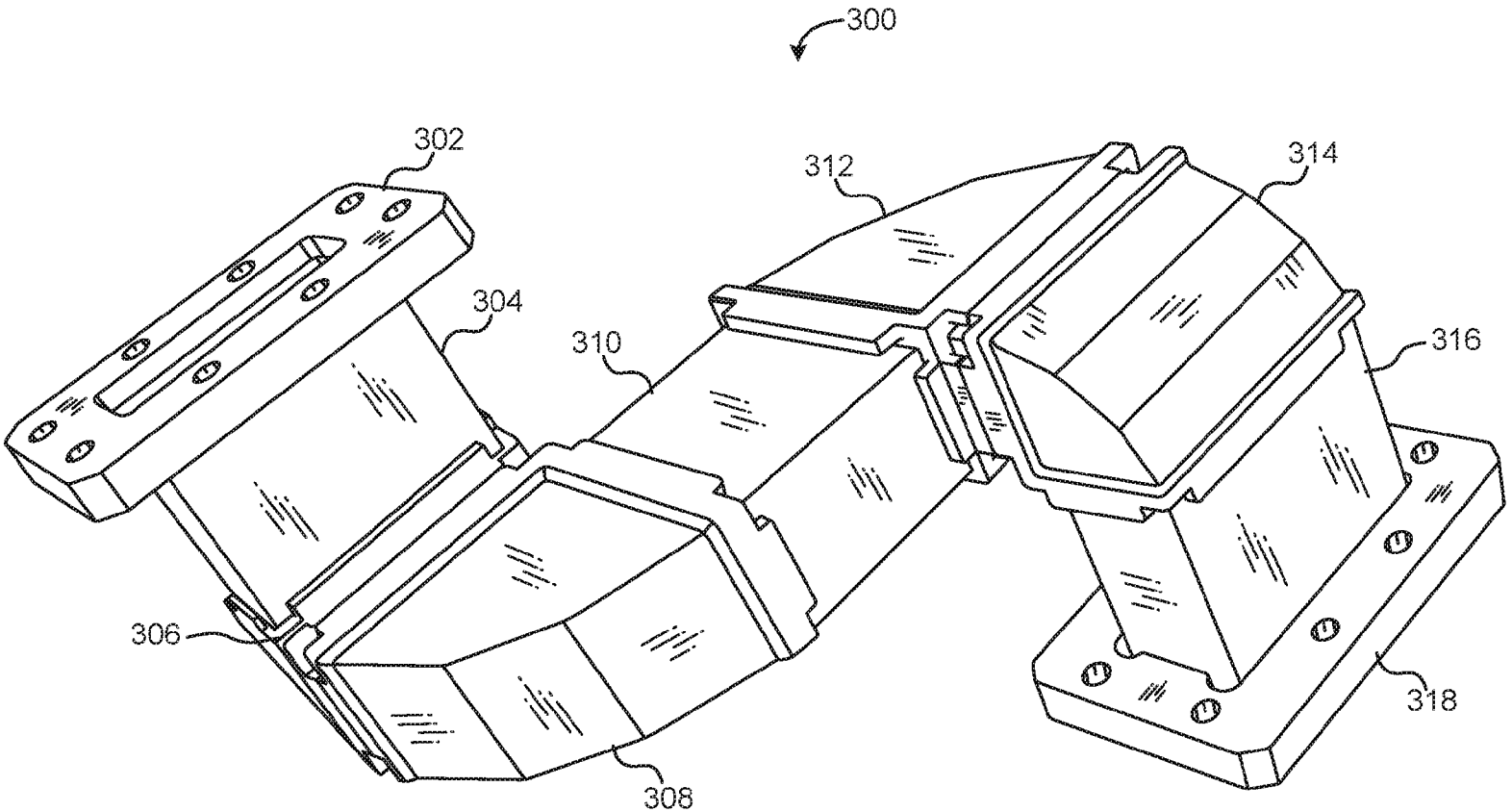
FIG. 3 (PRIOR ART)
FIG. 3 illustrates a waveguide unit in the prior art. The waveguide unit may be used to direct the waveguide around other components of a radio (e.g., receiver component or transmitter component) or antenna.
Figure 4:
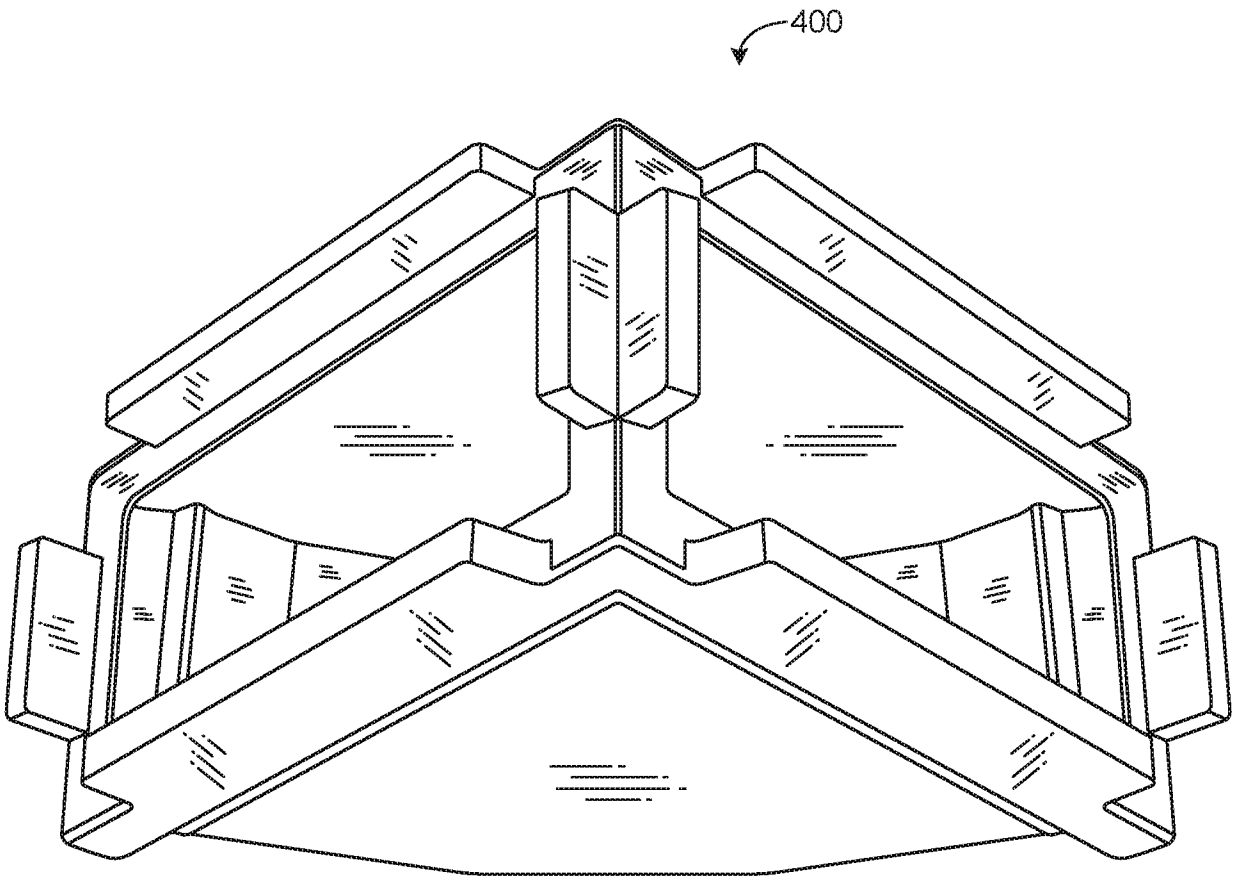
FIG. 4 (PRIOR ART)
FIG. 4 is a conventional H-bend in the prior art.
Figure 5:
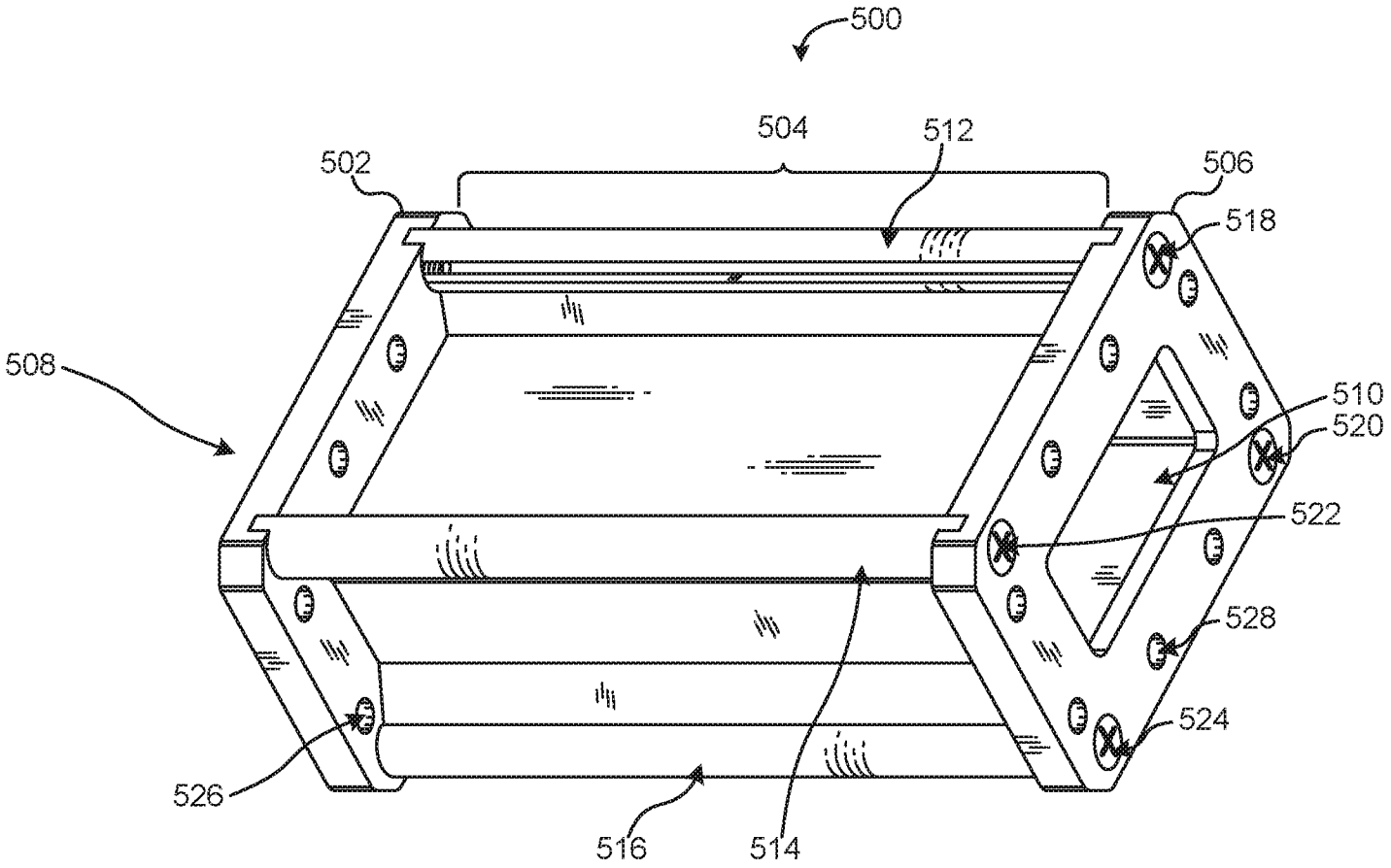
FIG. 5 depicts an exemplary waveguide assembly according to some embodiments.

FIG. 5 depicts an exemplary waveguide assembly 500 according to some embodiments. In some examples, the waveguide assembly 500 may be configured to couple a first waveguide assembly (e.g., couple an H-bend to an E-bend) to a second assembly, couple radio equipment (e.g., microwave transceiver) to a waveguide assembly, couple radio equipment to an antenna, or couple an antenna to another waveguide assembly. The waveguide assembly 500 may facilitate wave propagation along at least one dimension between a first end 508 and a second end 510 of the waveguide assembly 500.

In some embodiments, the waveguide assembly 500 may comprise a straight portion 504 coupled to flanges 502 and 506. Depending on the embodiment, the straight portion 504 may comprise aluminum, copper, or an alloy (e.g., brass), and may be formed using an extrusion or drawing manufacturing process. Additionally, the flanges 502 and 506, like the straight portion 504, may comprise aluminum, copper, or any alloy.

In various embodiments, the straight portion 504 may be constructed such that the straight portion 504 can be cut with ease in comparison to conventional straight portions, and without the need for specialized equipment. For example, the straight portion 504 may be constructed of extruded aluminum, and structurally configured such that the straight portion 504 can be cut at a cross section using a hacksaw. With such a construction, the straight portion 504 may be able to be shortened at a waveguide installation site, without the specialized equipment or skills typically needed to adjust conventional straight portions.

The straight portion 504 may comprise a metal tube having longitudinal features 512, 514, and 516 disposed on the tube's exterior surface. The straight portion 504 may also comprise a quadrilateral cross section. Though FIG. 5 illustrates the straight portion 504 as having a quadrilateral cross section, those of skill in the art would understand that in some embodiments the straight portion 504 may have an alternatively-shaped cross section. For example, the straight portion 504 may have an elliptical, circular, pentagonal, or hexagonal cross section such as shown in FIGS. 14A, 14B, 14C, and 14D, respectively, based on the desired capabilities of the waveguide assembly.

The cross section of the straight portion 504 may remain consistent throughout the length of the straight portion 504 or, alternately, may vary along the length of the straight portion 504. For instance, the cross section of the straight portion 504 may transition from quadrilateral shape at the first end 508 to circular shape at the second end 510 (e.g., when the waveguide assembly 500 is a circular to rectangular waveguide). In some embodiments, the transition from one cross section shape to another along the length of the straight portion 504 may be subtle and/or smooth. One or more cross section shapes may be formed along the length of the straight portion 504. For example, if the cross section of the straight portion 504 transitions from a quadrilateral shape at the first end 508 to a circular shape at the second end 510, the transition along the length of the straight portion may form an elliptical shape.

In various embodiments, the straight portion 504 may further comprise longitudinal features 512, 514, and 516, which may extend along the length of and be parallel to the straight portion 504. In some embodiments, the longitudinal features 512, 514, and 516 may be disposed on the exterior surface of the straight portion 504 and/or on the interior surface of the straight portion 504. For example, in some embodiments, where the straight portion 504 has a quadrilateral cross section, the longitudinal features 512, 514, and 516 (and one longitudinal feature that is hidden from view in FIG. 5) may be disposed on the exterior and/or interior surface of the straight portion 504 at the straight portion's four corners.

The longitudinal features 512, 514, and 516 may comprise attachment points for the flanges 502 and 506 and/or mounting features configured to receive a mounting bracket. For example, the longitudinal features 512, 514, and 516 may comprise attachment points (e.g., holes) that facilitate the coupling of the flange 502 to the first end 508 of the straight portion 504 and facilitate the coupling of the flange 506 to the second end 510. Where the longitudinal features 512, 514, and 516 comprises attachment points, the longitudinal features 512, 514, and 516 may be further configured to receive fasteners that assist in coupling the flanges 502 and 506 to the attachment points, or have embedded fasteners that assist in coupling the flanges 502 and 506 to the attachment points. For example, the longitudinal features 512, 514, and 516 may comprise attachment points (e.g., holes or threaded holes) configured to receive screws 518, 520, 522, and 524, respectively. One longitudinal feature is hidden from view in FIG. 5 and may be configured to receive screw 520. Examples of other fasteners that may be utilized with the longitudinal features 512, 514, and 516 include, without limitation, ties, clips, clasps, and (snap-on) buttons.

In various embodiments, the longitudinal features 512, 514, and 516 may be configured such that if the longitudinal features 512, 514, and 516 are cut at a cross section (e.g., as a result of the straight portion 504 being cut in order to shorten the overall length of the waveguide assembly 500), the longitudinal features 512, 514, and 516 would continue to comprise attachment points for the flanges 502 and 506 and/or mounting features configured to receive a mounting bracket. In some embodiments, for example, the longitudinal feature 512 may be configured such that before the longitudinal feature 512 is cut, the longitudinal feature 512 comprises an attachment point for the flange 506, and after the longitudinal feature 512 is cut at a cross section (e.g., by way of a hacksaw), the feature 512 comprises a new attachment point for the flange 506. In such embodiments, the act of cutting the longitudinal feature 512 causes the feature 512 to form a new attachment point. Additionally, depending on the embodiment, the attachment point that forms after the longitudinal feature 512 is cut may be similar to the attachment point that existed before the cut. In some embodiments, the formation of new attachment points upon cutting of the longitudinal feature 512 enables the longitudinal feature 512 to provide an attachment point for the flanges 502 and 504 regardless of whether the straight portion 504 is cut at a cross section for the purposes of shortening the waveguide assembly 500.

In some embodiments, the flanges 502 and 506 may assist in coupling the waveguide assembly 500 to connectable components, such as other waveguide assemblies, radio equipment, or antennas. In one example, the flanges 502 and 506 may comprise attachment points 526 and 528, which enable the flanges 502 and 506 to couple with the connectable components. The attachment points 526 and 528 may be configured to receive fasteners, such as screws.

Figure 6:
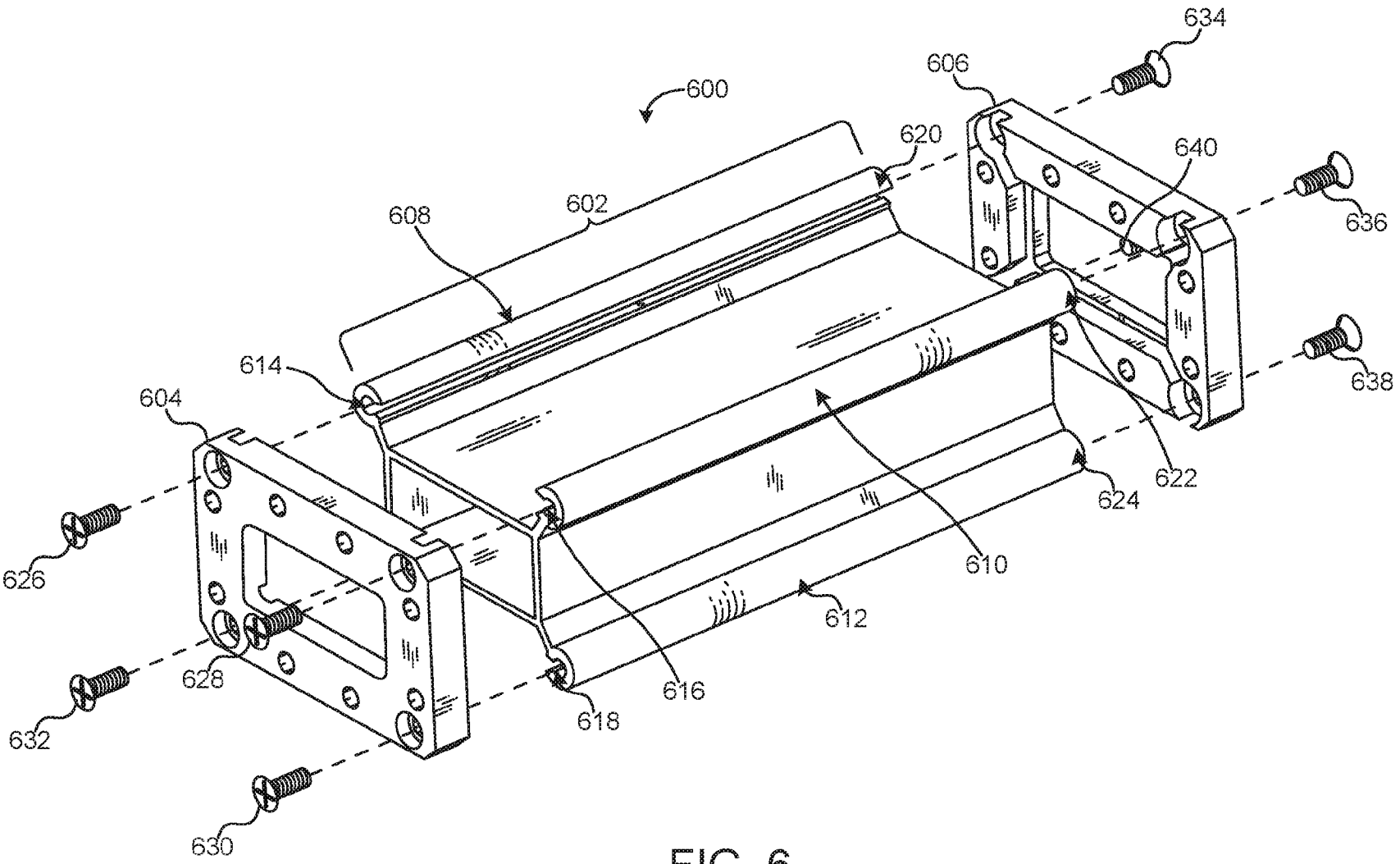
FIG. 6 depicts an exploded view of an example waveguide assembly according to some embodiments.

FIG. 6 depicts an exploded view of an example waveguide assembly 600 according to some embodiments. In some embodiments, the waveguide assembly 600 may comprise flanges 604 and 606 configured to couple to straight portion 602. The waveguide assembly 600 may be similar to the waveguide assembly 500 shown in FIG. 5. Depending on the embodiment, the straight portion 602 may comprise aluminum, copper, or an alloy (e.g., brass), and may be formed using an extrusion or drawing manufacturing process. Additionally, the flanges 604 and 606 may comprise aluminum, copper, or any alloy.

The straight portion 602 may comprise a metal tube having longitudinal features 608, 610, and 612 disposed on the tube's exterior surface and having a quadrilateral cross section. The longitudinal features 608, 610, and 612 may extend along the length of and be parallel to the length of the straight portion 602. As discussed herein, the longitudinal features 608, 610, and 612 may be disposed on the interior surface of the tube in another embodiment. The straight portion 602 may comprise an alternatively-shaped cross section, such as an elliptical, circular, pentagonal, or hexagonal cross section. Additionally, in various embodiments, where the straight portion 602 comprises a cross section shape that forms corners on the exterior or the interior of the tube (e.g., where the cross section shape is quadrilateral, four corners are formed), the longitudinal features 608, 610, and 612 may be disposed at the tube's corners.

The longitudinal features 608, 610, and 612 may respectively comprise attachment points 614, 616, and 618 configured to couple the flange 604 to the straight portion 602 using screws 626, 628, and 630, respectively. Likewise, the longitudinal features 608, 610, and 612 may comprise attachment points 620, 622, and 624 configured to couple the flange 606 to the straight portion 602 using screws 634, 636, and 638 respectively. In some embodiments, a longitudinal feature that is hidden from view may be configured to couple the flange 604 to the straight portion 602 using screw 632, and couple the flange 606 to the straight portion 602 using screw 640.

In some embodiments, the straight portion 602 may be cut with ease in comparison to conventional straight portions, and without the need for specialized equipment typically utilized with conventional straight portions. For example, the straight portion 602 may be constructed of extruded aluminum, and structurally configured such that the straight portion 602 may be cut at a cross section using a hacksaw. Such a capability may enable the straight portion 602 to be shortened at a waveguide installation site, thereby shortening the waveguide assembly 600 without the need of specialized equipment or skills typically needed to adjust conventional straight portions. Further, when the straight portion 602 is cut, the longitudinal features 608, 610, and 612 may be similarly cut. In some embodiments, regardless of where the longitudinal features 608, 610, and 612 are cut, the longitudinal features 608, 610, and 612 may still comprise attachment points for the flanges 604 and 606 and/or mounting features.

Figure 7:
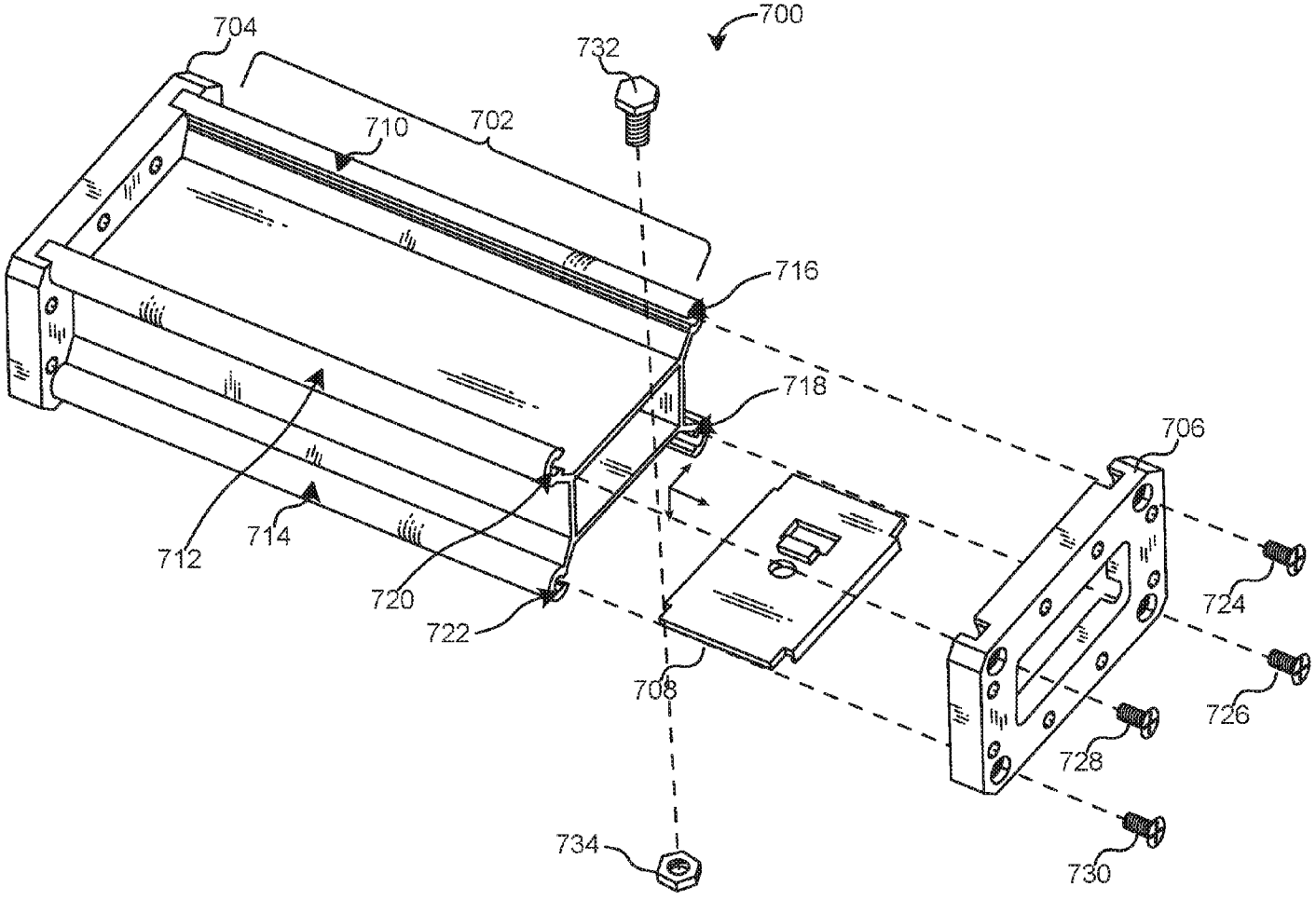
FIG. 7 depicts an exploded view of an exemplary waveguide assembly with an exemplary mounting bracket in according to some embodiments.

FIG. 7 depicts an exploded view of an exemplary waveguide assembly 700 with an exemplary mounting bracket 708 according to some embodiments. The waveguide assembly 700 may comprise flanges 704 and 706 configured to couple to straight portion 702. The waveguide assembly 700 may also comprise a mounting bracket 708 configured to couple with the straight portion 702 to assist in mounting the waveguide assembly 700 to a frame. As discussed herein, in some embodiments, the straight portion 702 may comprise aluminum, copper, or an alloy (e.g., brass), and may be formed using an extrusion or drawing manufacturing process. Additionally, the flanges 704 and 706 may comprise aluminum, copper, or any alloy. In some embodiments, the straight portion 702 and the flanges 704 and 706 may be similar to those found in the waveguide assembly 500 shown in FIG. 5 and/or the waveguide assembly 600 shown in FIG. 6.

As shown in FIG. 7, the straight portion 702 may comprise a metal tube having longitudinal features 710, 712, and 714 disposed on the tube's exterior surface and having a quadrilateral cross section. The longitudinal features 710, 712, and 714 may extend along the length of the straight portion 702, and may be parallel to the length of the straight portion 702. As discussed herein, the straight portion 702 may comprise an alternatively-shaped cross section, such as an elliptical, circular, pentagonal, or hexagonal cross section. Additionally, in various embodiments, where the straight portion 702 comprises a cross section shape that forms corners on the exterior or the interior of the tube, the longitudinal features 710, 712, and 714 may be disposed at the tube's exterior or interior corners.

The longitudinal features 710, 712, and 714 may respectively comprise attachment points 716, 718, 720, and 722 configured to couple the flange 706 to the straight portion 702 using screws 724, 728, and 730 respectively. A longitudinal feature of the straight portion 702 that is hidden from view in FIG. 7 may comprise attachment point 718, which may be configured to couple the flange 706 to the straight portion 702 using screw 726. The flange 704 as shown is coupled with the straight portion 702, via other attachments points of the longitudinal features 710, 712, and 714.

As disclosed herein, the longitudinal features 710, 712, and 714 may comprise mounting features configured to receive a mounting bracket 708, thereby coupling the mounting bracket 708 to the straight portion 702. For example, the longitudinal features 710 and 712 may be configured to form a pair of rails operable to slidingly receive the mounting bracket 708 such that the mounting bracket 708 is coupled to the straight tubular portion 702.

In some embodiments, the attachment points 716 and 720 may be configured to function both as a pair of rail receiving points for the mounting bracket 708 and function as attachment points for the flange 706. Similarly, the attachment points 718 and 722 may be configured to both function as the pair of rail receiving points for the mounting bracket 708 and function as attachment points for the flange 706.

Correspondingly, the mounting bracket 708 may be configured to be inserted into the rails formed by the pair of the longitudinal features 710 and 712 via the attachment points 716 and 720. For example, the mounting bracket 708 may be oriented and configured to be inserted into longitudinal features at the bottom of the straight portion 702 (i.e., into the pair of rails formed by the longitudinal feature 722 and the longitudinal feature hidden from view) via the attachment points 718 and 722.

In some embodiments, the mounting bracket 708 and/or the straight portion 702 may be configured such that the mounting bracket 708 can be inserted into any pair of rails formed by any two, adjacent longitudinal features on the exterior or interior surface of the straight portion 702. For example, the pair of rails may be formed by the longitudinal features 712 and 722 or by the longitudinal feature 710 and the longitudinal feature hidden from view. Further, in some embodiments, the mounting bracket 708 may be inserted into a pair of rails from either end of the straight portion 702. Depending on embodiment, the mounting bracket 708 may be inserted into the pair of rails before one or both of the flanges 704 and 706 are coupled to the straight portion 702, thereby allowing the mounting bracket 708 to be inserted into a pair of rails via a set of open attachment points (e.g., attachment points 716, 718, 720, and 722).

Although the mounting bracket 708 is shown as having a planar structure that corresponds to the planar, exterior surface of the straight portion 702, those of ordinary skill in the art would understand that in some embodiments the structure of the mounting bracket 708 may have an alternative structure that corresponds to an alternatively-shaped exterior surface of the straight portion 702. For example, in some embodiments where the exterior surface of the straight portion 702 has a curvilinear shape (e.g., the straight portion has a circular cross section), and the mounting bracket 708 has a corresponding curvilinear structure.

In order for the mounting bracket 708 to couple to a frame, such as that of a radio equipment rack, the mounting bracket 708 may comprise a coupling mechanism configured to couple the mounting bracket 708 to the frame. For example, in FIG. 7, the mounting bracket 708 is shown to comprise a bolt 732 and a corresponding nut 734 that together function as a coupling mechanism for the mounting bracket 708. In some embodiments, the bolt 732 may be inserted through an aperture of the mounting bracket 708 before the mounting bracket is coupled to the straight portion 702 (e.g., before the mounting bracket 708 is inserted into a pair of rails formed by the longitudinal features 710, 712, and 714). Subsequent to the bolt 734 being inserted through the mounting bracket 708, the nut 734 may be coupled to the bolt 734, after the waveguide assembly 700 is disposed on the frame (e.g., of a radio equipment rack). In various embodiments, once the mounting bracket 708 with the bolt 732 is coupled to the straight portion 702, the bolt 732 and the nut 734 combination may be utilized to couple the straight portion 702 to the frame of a radio equipment rack, thereby coupling the waveguide assembly 700 to the frame.

Figure 8:
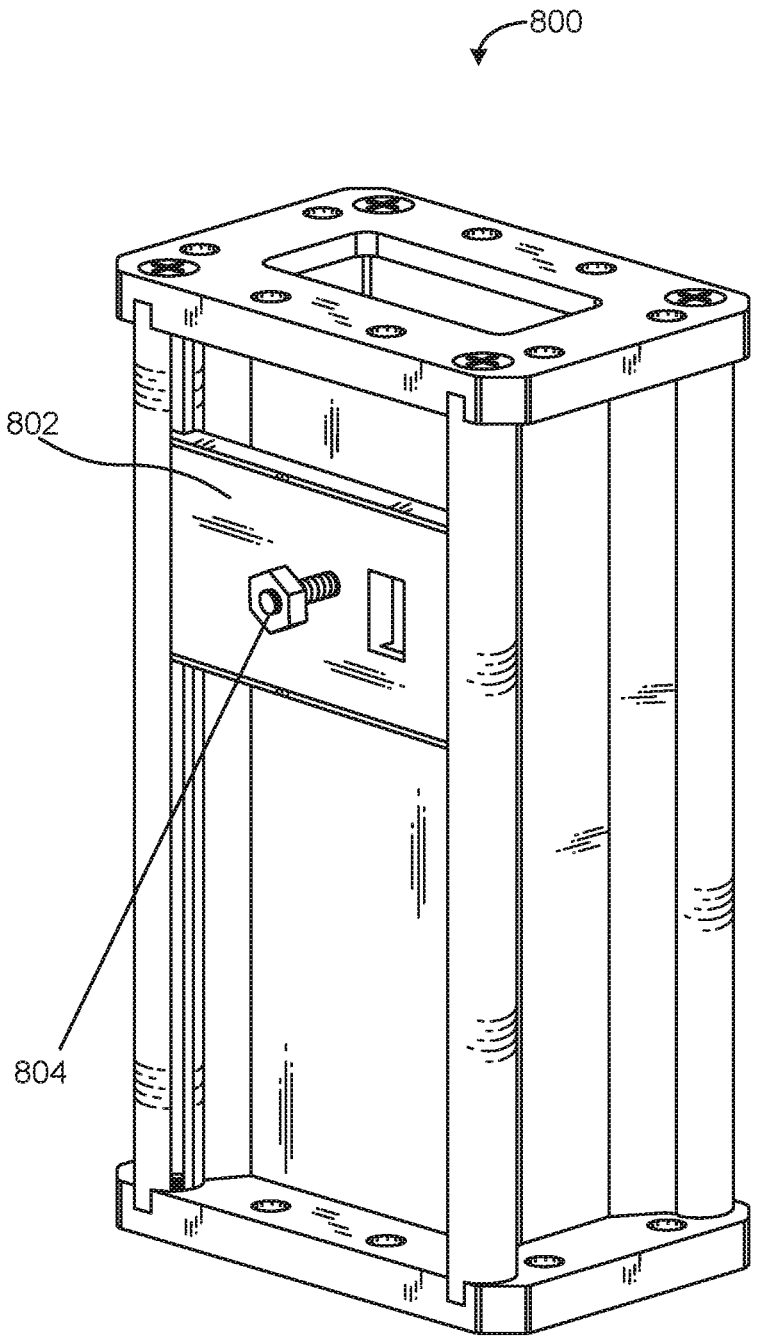
FIG. 8 depicts an exemplary waveguide assembly having an exemplary mounting bracket according to some embodiments.

FIG. 8 illustrates how the waveguide assembly 700 of FIG. 7 may appear in some embodiments once the mounting bracket 708 of FIG. 7 and the flanges 704 and 706 of FIG. 7 are coupled to the straight portion 702 of FIG. 7. FIG. 8 depicts an exemplary waveguide assembly 800 having an exemplary mounting bracket 802 according to some embodiments. The bracket 802 comprises a bolt and nut combination 804. It should be noted that while the end of the bolt and nut combination 804 is shown in FIG. 8, the head of the bolt is hidden from view.

Figure 9:
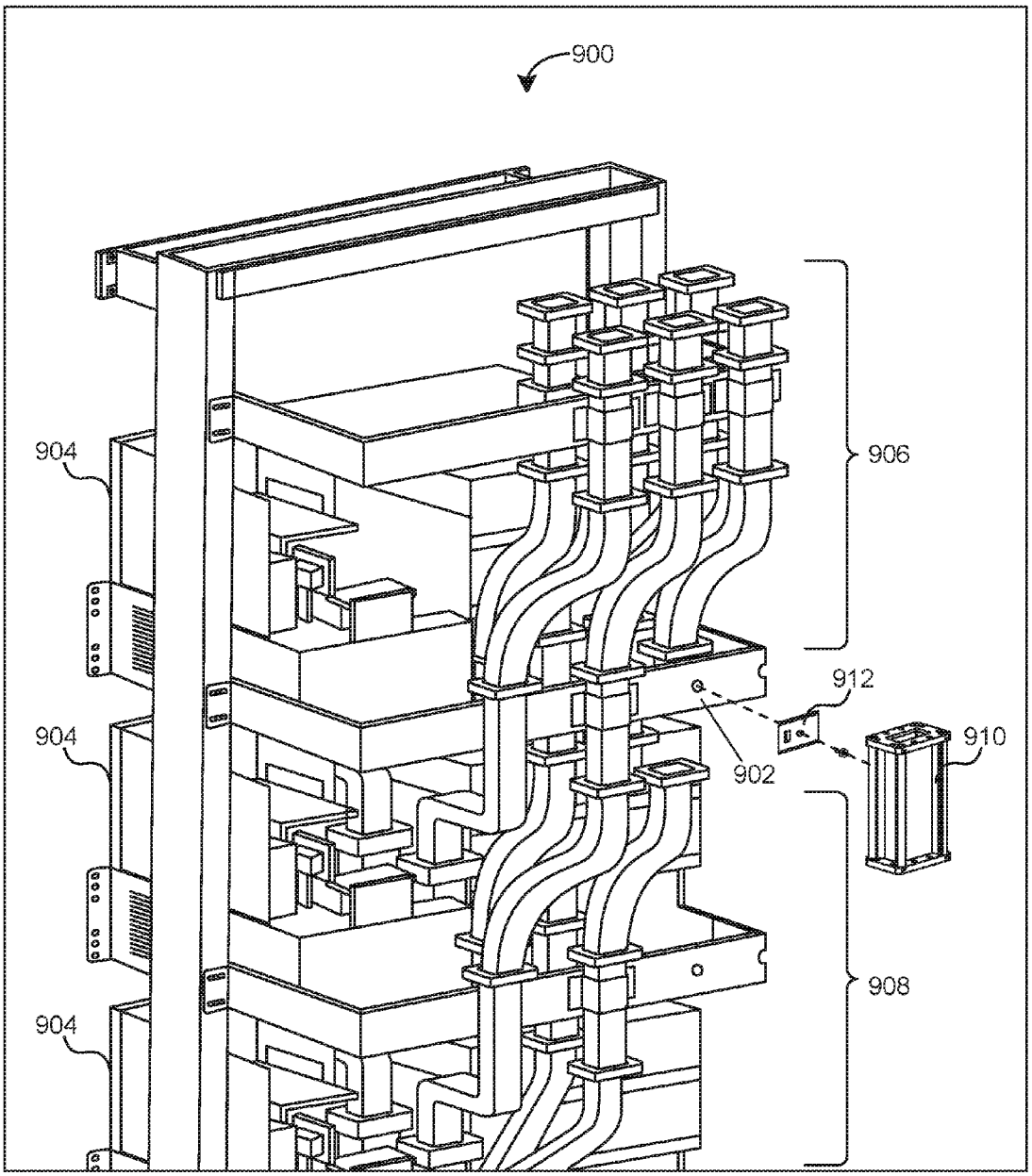
FIG. 9 depicts an exemplary waveguide assembly being mounted to a rack using a mounting bracket in accordance with some embodiments.

FIG. 9 depicts an exemplary waveguide assembly 910 being mounted to a rack 900 using a mounting bracket 912 in accordance with some embodiments. The waveguide assembly 910 may be similar to the waveguide assembly 700 of FIG. 7, and the mounting bracket 912 may be similar to the mounting bracket 708 illustrated in FIG. 7.

In various embodiments, the rack 900 may be adapted to receive and rack mount (i.e., hold) radio equipment 904 utilized in a communication system, such as a microwave communication system. For instance, the rack 900 may be adapted to receive and hold microwave transceivers for one or more microwave communication systems. Waveguide structures 906 and 908 may couple the radio equipment 904 to connectable components, such as antennas, other radio equipment, or additional waveguide assemblies. Generally, the waveguide structures 906 and 908 are configured to carry radio waves to and from the radio equipment 904 (e.g., extend the transmit and receive ports of microwave equipment to the top of the rack for connection to the antennas) and cause the radio waves carried by the waveguide assemblies 906 and 908 to propagate along a single dimension.

In FIG. 9, the waveguide assembly 910 is shown to be coupled to a frame 902 of the rack 900 using the mounting bracket 912. Once coupled to the rack 900, the waveguide assembly 910 may be further coupled at one or both ends to the waveguide structures 906 and 908, thereby becoming part of one or both waveguide structures 906 and 908. As noted herein, the waveguide assembly 910 may utilize flanges coupled at the ends of the waveguide assemblies (i.e., to the waveguide assembly's straight portion) in order to couple the waveguide assembly 910 to the waveguide structures 906 and 908.

Figure 10:
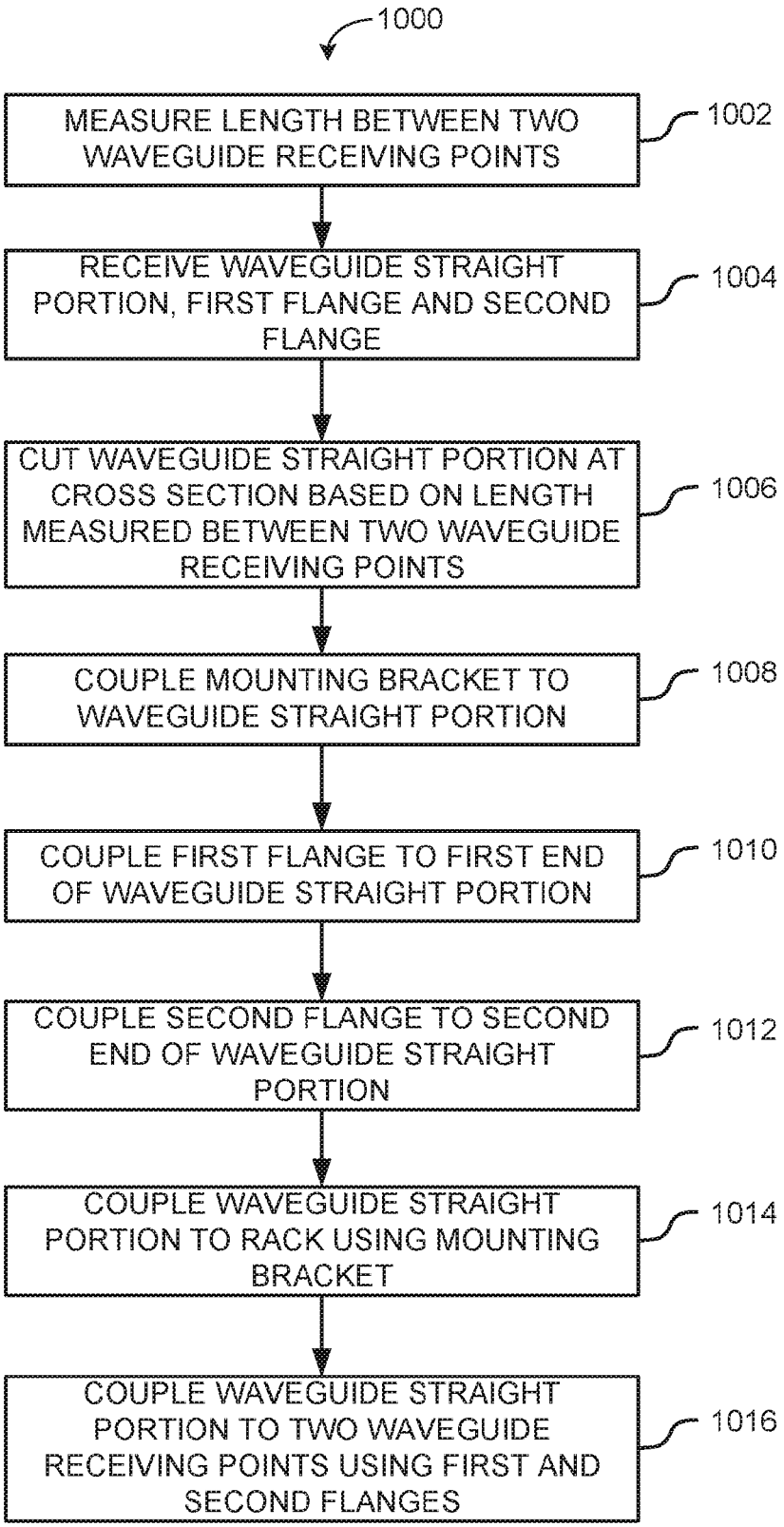
FIG. 10 is a flowchart of an exemplary method for installing a waveguide assembly according to some embodiments.

FIG. 10 is a flowchart of an exemplary method 1000 for installing a waveguide assembly according to some embodiments. At step 1002, a length between the receiving point of the waveguide structure 906 and the receiving point of the waveguide structure 908 is measured.

After measurement, at step 1004, a (waveguide) straight portion 702, a first flange 704 and a second flange 706 (see FIG. 7) may be received. In some embodiments, the straight portion 702 may be greater than or equal to the length measured at step 1002. Further, in some embodiments, each flange (i.e., each of flanges 704 and 706) may have a profile width that is less than the length measured at step 1002. By ensuring that the length of the straight portion 702 is greater than or equal to the length measured at step 1002 and assuming that each flange has a profile width of less than the length, then the assembled waveguide assembly may be configured to fit within the available space.

At step 1006, the straight portion 702 may be cut at a cross section based on the length measured at step 1002. For example, the straight portion 702 may be cut if the length of the straight portion 702 when coupled to the first flange 704 and the second flange 706 is longer than the length measured as step 1002. As noted herein, the straight portion 702 may be cut at a cross section to shorten the overall length of the waveguide assembly 700. Further, the straight portion 702 may be shortened such that once the straight portion 702 is coupled to the first flange 704 and the second flange 706, the resulting waveguide assembly 700 may be disposed snuggly between the receiving point of the waveguide structure 906 and the receiving point of the waveguide structure 908. As discussed herein, the straight portion 702 may be cut at a cross section using a basic cutting tool, such as a hacksaw.

At step 1008, a mounting bracket 708 may be coupled to the waveguide straight portion 702. As noted herein, the mounting bracket 708 may be coupled to the straight portion 702 using a pair of rails formed by at least two of the longitudinal features 710, 712, and 714 disposed on the exterior surface of the straight portion 702.

At step 1010, the first flange 704 may be coupled to a first end of the straight portion 702 and, at step 1012, the second flange 706 may be coupled to a second end of the straight portion 702. As described herein, the first flange 704 may be coupled to the first end of the straight portion 702 via attachments points disposed on the first end, and the second flange 706 may be coupled to the second end of the straight portion 702 via attachments points 716, 718, 720, and 722 disposed on the second end. In some embodiments, once the first and second flanges 704 and 706 are coupled to the straight portion 702, the assembly of the waveguide assembly 700 may be considered completed. Subsequently, at step 1014, the waveguide assembly 700 may be coupled to a rack 900 using the mounting bracket 708 (illustrated separately as mounting bracket 912 in FIG. 9). In some embodiments, the waveguide assembly 700 may be coupled to a frame 902 of the rack 900, and disposed between the waveguide structure 906 and the waveguide structure 908.

Once disposed between the waveguide structure 906 and the waveguide structure 908, at step 1016, the waveguide assembly 700 may be coupled to the receiving point of the waveguide structure 906 and the receiving point of the waveguide structure 908. As described herein, the waveguide assembly 700 may couple to the waveguide structure 906 and the waveguide structure 908 using the first and second flanges 704 and 706.

It should be understood that those of ordinary skill in the art would appreciate that one or more steps of method 1000 as illustrated in FIG. 10 could be performed in the context of other systems or components, and in alternative sequences.

Figure 11:
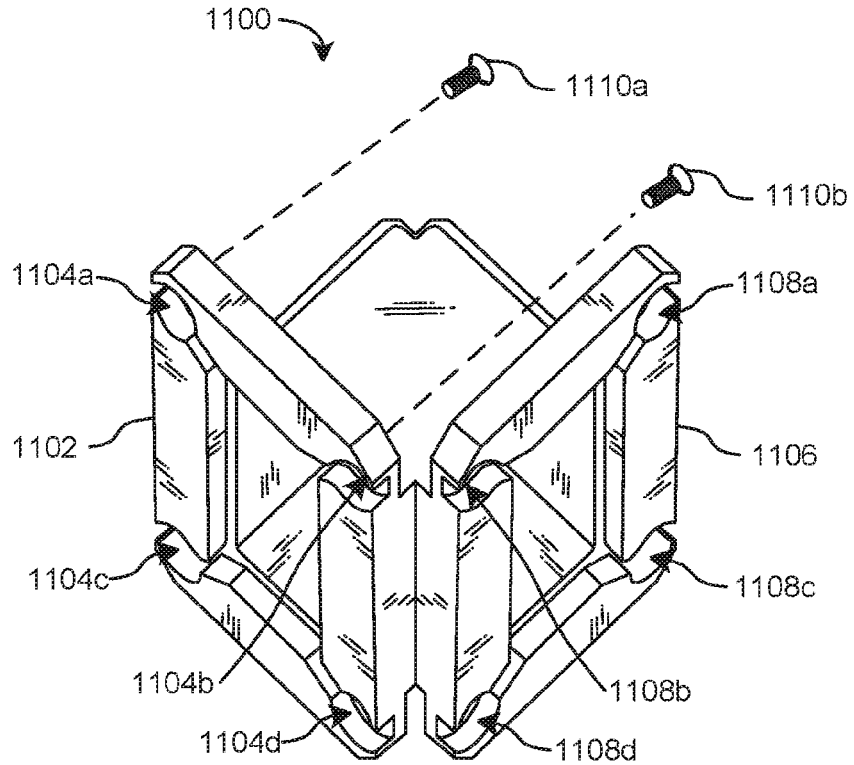
FIG. 11 depicts an exemplary E-bend according to some embodiments.

FIG. 11 depicts an exemplary E-bend 1100 according to some embodiments. The E-bend 1100 comprises a first flange feature 1102 and a second flange feature 1106, each of which is configured to receive and couple with a flange from a straight waveguide assembly or a waveguide bend.

The first flange feature 1102 and the second flange feature 1106 may comprise attachment points 1104*a*, 1104*b*, 1104*c*, 1104*d*, 1108*a*, 1108*b*, 1108*c* and 1108*d* utilized in coupling the E-bend 1100 with connectable components, such as other waveguide assemblies, radio equipment, or antennas. In various embodiments, the attachment points 1104*a*-1104*d* and 1108*a*-1108*d* may correspond to flanges disposed on connectable components (e.g., other waveguide assemblies, radio equipment, or antennas). In some embodiments, the flange features 1102 and 1106 may be configured to receive and couple with some or all the flanges illustrated in FIGS. 5-9, thereby making them compatible with the waveguide assemblies illustrated in FIGS. 5-9 as well as, potentially, any waveguide unit. Further, in some embodiments, the flange features 1102 and 1106 may be configured to receive and couple with the straight portions illustrated in FIGS. 5-9 without the need for the flanges illustrated in FIGS. 5-9.

Additionally, in some embodiments, the attachment points 1104*a*-1104*d* and 1108*a*-1108*d* may be configured to receive screws, such as screws 1110*a*, 1110*b*, in order to couple the E-bend 1100 with connectable components (e.g., other waveguide components, radio equipment, or antennas). As shown, the E-bend 1100 is configured to couple two connectable components together.

Figure 12:
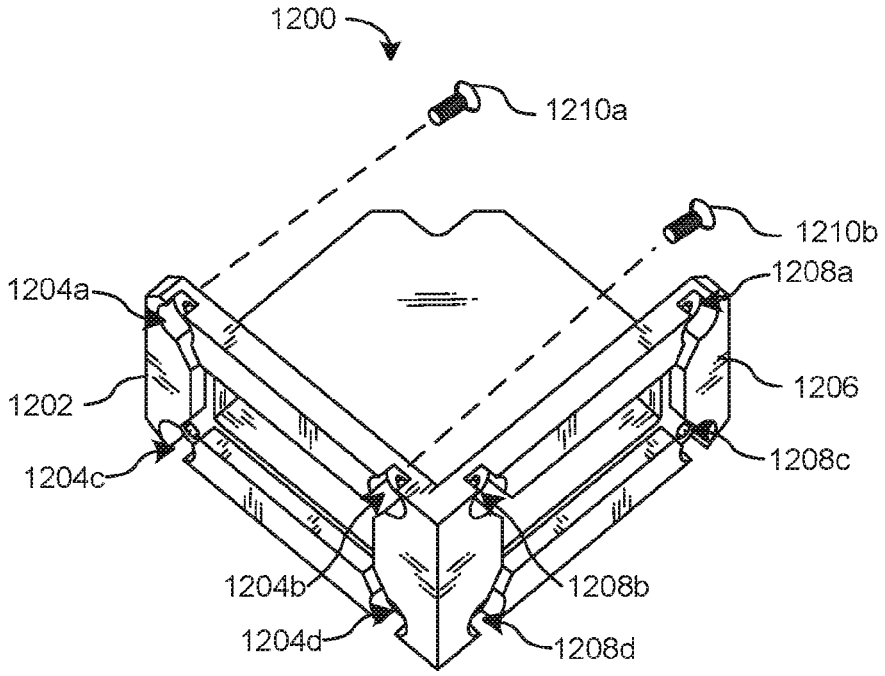
FIG. 12 depicts an exemplary H-bend according to some embodiments.

FIG. 12 depicts an exemplary H-bend 1200 according to some embodiments. As shown, the H-bend 1200 comprises a first flange feature 1202 and a second flange feature 1206, each of which may be configured to receive and couple with a flange from a straight waveguide assembly or a waveguide bend.

The first flange feature 1202 and the second flange feature 1206 may comprise attachment points 1204*a*, 1204*b*, 1204*c*, 1204*d*, 1208*a*, 1208*b*, 1208*c* and 1028*d* utilized in coupling the H-bend 1200 with connectable components, such as other waveguide assemblies, radio equipment, or antennas. In various embodiments, the attachment points 1204*a*-1204*d* and 1208*a*-1208*d* may correspond to flanges disposed on connectable components (e.g., other waveguide assemblies, radio equipment, or antennas). For example, in some embodiments, the flange features 1202 and 1206 may be configured to receive and couple with some or all the flanges illustrated in FIGS. 5-9, thereby making them compatible with the waveguide assemblies illustrated in FIGS. 5-9 as well as, potentially, waveguide units. Further, in some embodiments, the flange features 1202 and 1206 may be configured to receive and couple with the straight portions illustrated in FIGS. 5-9 without the need for the flanges illustrated in FIGS. 5-9.

Additionally, in some embodiments, the attachment points 1204*a*-1204*d* and 1208*a*-1208*d* may be utilized with screws, such as screws 1210*a*, 1210*b*, in order to couple the H-bend 1200 with connectable components (e.g., other waveguide assemblies, radio equipment, or antennas). The H-bend 1200 may be configured to couple two connectable components together.

Figure 13:
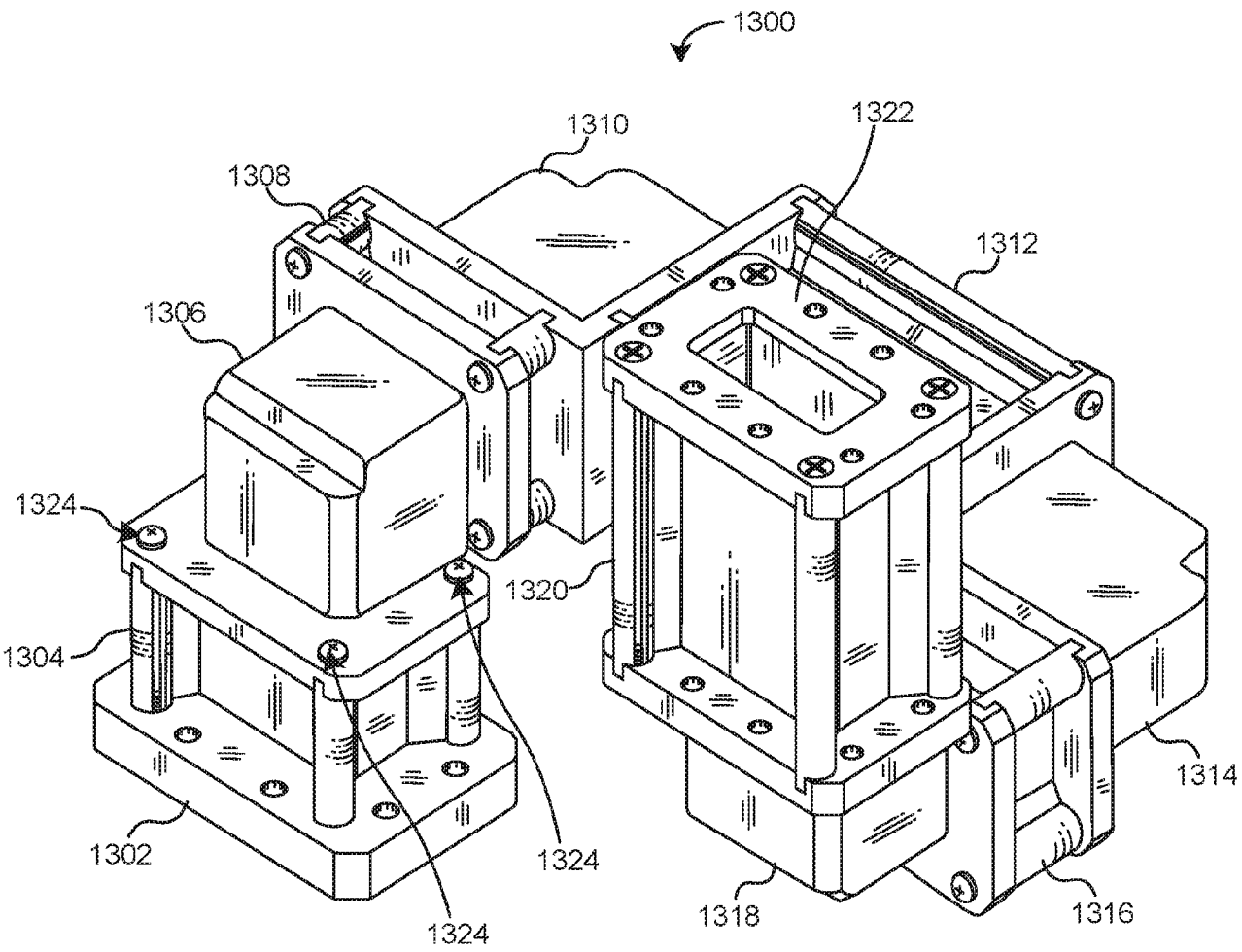
FIG. 13 is a drawing illustrating exemplary waveguide assemblies according to some embodiments.
Figure 14A:
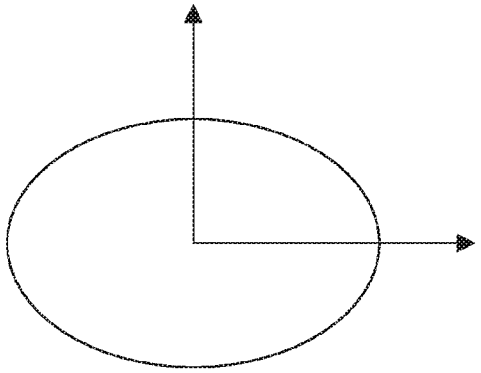
FIGS. 14A, 14B, 14C, and 14D depict exemplary cross section shapes according to some embodiments.
Figure 14B:
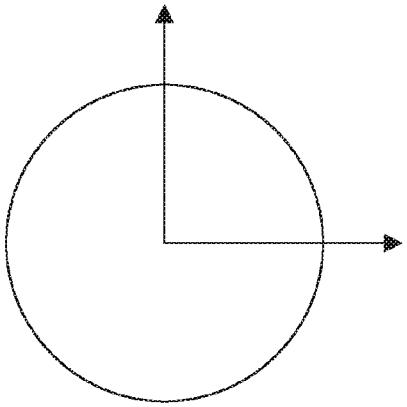
Figure 14C:
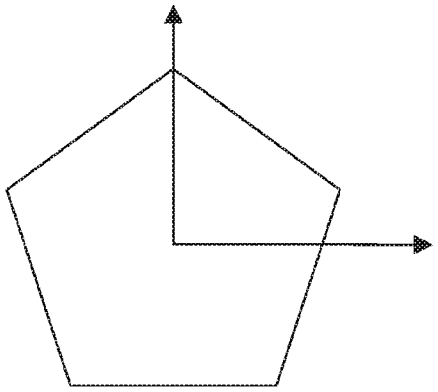
Figure 14D:
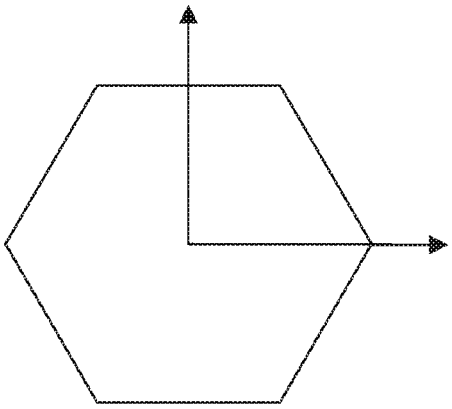

FIG. 13 depicts exemplary waveguide assemblies 1300 according to some embodiments. As shown, the waveguide assembly 1300 comprises flanges 1302 and 1322, straight portions 1304, 1308, 1312, 1316, and 1320, E-bends 1306, and 1318, and H-bends 1310 and 1314. As also shown, the various components of waveguide assembly 1300 are coupled together using screws 1324. In some embodiments, the flanges 1302 and 1322 are similar to some or all of the flanges illustrated in FIGS. 5-9, and the straight points 1304, 1308, 1312, 1316, and 1320 are similar to some or all of the straight portions illustrated in FIGS. 5-9. It should be noted that in FIG. 13, the E-bends 1306, and 1318, and the H-bends 1310 and 1314 are shown to be coupled with the straight portions 1304, 1308, 1312, 1316, and 1320 without the need of the flanges.

Those skilled in the art will appreciate that the waveguide assemblies discussed herein, in various embodiments, may be coupled with the fused waveguide components or other waveguide structures in the prior art.

Various embodiments are described herein as examples. It will be apparent to those skilled in the art that various modifications may be made and other embodiments can be used without departing from the broader scope of the present invention. Therefore, these and other variations upon the exemplary embodiments are intended to be covered by the present invention(s).

What is claimed is:

1. A waveguide assembly, comprising:

a straight hollow portion having a length, the straight hollow portion further including a first open end and a second open end;

a first longitudinal feature disposed on a first surface of the straight hollow portion, the first longitudinal feature comprising at least one first attachment point, the at least one first attachment point configured to receive at least one first fastener to mechanically fasten the first open end to a first attachable flange;

the first attachable flange with an open portion, the first attachable flange configured to be mechanically fastened by the at least one fastener to the straight hollow portion at the at least one first attachment point such that the first open end of the straight hollow portion aligns with the open portion of the first attachable flange;

a second longitudinal feature disposed on the first surface of the straight hollow portion, the second longitudinal feature comprising at least one second attachment point configured to receive at least one second fastener to mechanically fasten the second open end to a second attachable flange; and the second attachable flange with an open portion, the second attachable flange configured to be mechanically fastened by the at least one second fastener to the straight hollow portion at the at least one second attachment point such that the second open end of the straight hollow portion aligns with the open portion of the second attachable flange;

wherein the first longitudinal feature comprises a first portion of a first common longitudinal feature, and the second longitudinal feature comprises a second portion of the first common longitudinal feature.

2. The waveguide assembly of claim 1, wherein the first surface comprises an exterior surface or an interior surface of the straight hollow portion.

3. The waveguide assembly of claim 1, wherein the straight hollow portion is configured to be cut along a cross section of the straight hollow portion to form the first open end.

4. The waveguide assembly of claim 1, wherein a cross section of the straight hollow portion is rectangular.

5. The waveguide assembly of claim 1, wherein a cross section of the straight hollow portion is elliptical.

6. The waveguide assembly of claim 1, wherein the at least one first fastener is a screw.

7. The waveguide assembly of claim 1, wherein the at least one first attachment point is a screw hole.

8. The waveguide assembly of claim 1, wherein the first attachable flange is configured to couple the waveguide assembly to another waveguide assembly.

9. The waveguide assembly of claim 8, wherein the other waveguide assembly is an E-bend or an H-bend.

10. The waveguide assembly of claim 1, wherein the straight hollow portion is at least partially composed of aluminum.

11. The waveguide assembly of claim 1, further comprising a second common longitudinal feature disposed on the first surface of the straight hollow portion, the second common longitudinal feature disposed parallel to the first common longitudinal feature.

12. The waveguide assembly of claim 11, wherein the first common longitudinal feature and the second common longitudinal feature are configured to receive a mounting bracket, the mounting bracket configured to assist in mounting the waveguide assembly to a frame.

13. The waveguide assembly of claim 11, wherein the first common longitudinal feature and the second common longitudinal feature are configured to form a pair of rails operable to slidingly receive a mounting bracket such that the mounting bracket is coupled to the straight hollow portion.

14. The waveguide assembly of claim 1, wherein the straight hollow portion is configured to be cut along a cross section of the straight hollow portion to configure the at least one first attachment point to receive the at least one first fastener.

15. A method for preparing a waveguide assembly for installation, the method comprising:

measuring a first length between a first waveguide receiving point and a second waveguide receiving point;

receiving a waveguide hollow portion including a first open end and a second open end, a first longitudinal feature being disposed on a first surface of the waveguide hollow portion and a second longitudinal feature being disposed on the first surface of the waveguide hollow portion, the first longitudinal feature comprising at least one first attachment point, the second longitudinal feature comprising at least one second attachment point, the first longitudinal feature further comprising a first portion of a common longitudinal feature, and the second longitudinal feature further comprising a second portion of the common longitudinal feature, the waveguide hollow portion further including a second length that is greater than or equal to the first length;

shortening the waveguide hollow portion from the second length to a third length to configure the at least one first attachment point to receive a first attachable flange, and to configure the at least one second attachment point to receive a second attachable flange, wherein the third length is less than the second length;

mechanically fastening the first attachable flange to the waveguide hollow portion with a first fastener at the at least one first attachment point such that the first open end of the waveguide hollow portion aligns with an open portion of the first attachable flange; and mechanically fastening the second attachable flange to the waveguide hollow portion with a second fastener at the at least one second attachment point such that the second open end of the waveguide hollow portion aligns with an open portion of the second attachable flange.

16. The method of claim 15, wherein a cross section of the waveguide hollow portion is rectangular.

17. The method of claim 15, wherein a cross section of the waveguide hollow portion is elliptical.

18. The method of claim 15, wherein the first fastener is a screw.

19. The method of claim 15, wherein the at least one first attachment point is a screw hole.

20. The method of claim 15, further comprising coupling the first attachable flange to another waveguide assembly.

21. The method of claim 20, wherein the other waveguide assembly is an E-bend or an H-bend.

22. The method of claim 15, wherein the waveguide hollow portion is at least partially composed of aluminum.

23. The method of claim 15, wherein mechanically fastening the first attachable flange to the waveguide hollow portion with the first fastener at the at least one first attachment point comprises coupling the first attachable flange to the first waveguide receiving point, and wherein mechanically fastening the second attachable flange to the waveguide hollow portion with the second fastener at the at least one second attachment point comprises coupling the second attachable flange to the second waveguide receiving point.

24. The method of claim 23, wherein the third length of the waveguide hollow portion is equal to the first length between the first waveguide receiving point and the second waveguide receiving point.

25. The method of claim 23, wherein the first attachable flange has a first profile width, the second attachable flange has a second profile width, and the third length of the waveguide hollow portion combined with the first profile width and the second profile width is equal to the first length.

26. The method of claim 15, wherein shortening the waveguide hollow portion includes cutting the waveguide hollow portion along a cross section of the waveguide hollow portion to form the first open end.

* * * * *